US006766632B2

(12) United States Patent
Chang

(10) Patent No.: US 6,766,632 B2
(45) Date of Patent: Jul. 27, 2004

(54) STIRRUP WITH RELATIVELY MOVABLE FOOTREST AND HANGER

(75) Inventor: Chia Wei Chang, Moreno Valley, CA (US)

(73) Assignee: Eastwest International (Taiwan) Enterprises, Taichung (TW)

( * ) Notice: Subject to any disclaimer, the term of this patent is extended or adjusted under 35 U.S.C. 154(b) by 0 days.

(21) Appl. No.: 10/367,107

(22) Filed: Feb. 14, 2003

(65) Prior Publication Data

US 2003/0145564 A1 Aug. 7, 2003

Related U.S. Application Data

(63) Continuation-in-part of application No. 10/056,561, filed on Jan. 25, 2002, now abandoned.

(51) Int. Cl.[7] ..... B68C 3/00
(52) U.S. Cl. ..... 54/48; 54/47
(58) Field of Search ..... 54/47–49.5

(56) References Cited

U.S. PATENT DOCUMENTS

| | | | | | |
|---|---|---|---|---|---|
| 33,354 | A | * | 9/1861 | Livingston | 54/48 |
| 103,031 | A | * | 5/1870 | Dunnagan | 54/48 |
| 202,974 | A | | 4/1878 | Wiley | |
| 222,556 | A | | 12/1879 | Whitman | |
| 376,526 | A | | 1/1888 | Jennings et al. | |
| 1,160,082 | A | | 11/1915 | Jarvis | |
| 1,622,510 | A | * | 3/1927 | Hendriks | 54/49 |
| 1,639,073 | A | * | 8/1927 | Berbaum | 54/47 |
| 2,098,141 | A | | 11/1937 | Galbreath | 54/48 |
| 2,187,983 | A | | 1/1940 | Moore | 54/47 |
| 3,804,216 | A | | 4/1974 | Katsumori et al. | 188/314 |
| 3,905,179 | A | | 9/1975 | Bischeltsrieder | 54/47 |
| 4,199,639 | A | | 4/1980 | Rone | 428/138 |
| 4,936,081 | A | | 6/1990 | Jones | 54/48 |
| 5,172,538 | A | | 12/1992 | Luger | 54/47 |
| 5,930,986 | A | * | 8/1999 | Meaghan et al. | 54/47 |
| 5,979,149 | A | * | 11/1999 | Martin | 54/49 |
| 6,062,007 | A | | 5/2000 | Cargill | 54/47 |
| 6,220,004 | B1 | * | 4/2001 | Hsi-Chang | 54/48 |
| 6,425,230 | B2 | | 7/2002 | Vollmecke et al. | 54/48 |
| 2001/0045084 | A1 | * | 11/2001 | Vollmecke et al. | 54/47 |

FOREIGN PATENT DOCUMENTS

| | | | | |
|---|---|---|---|---|
| DE | 3317859 A1 | * | 11/1984 | B68C/3/00 |
| WO | WO 9525692 A1 | * | 9/1995 | B68C/3/02 |

* cited by examiner

*Primary Examiner*—Charles T. Jordan
*Assistant Examiner*—Bret Hayes
(74) *Attorney, Agent, or Firm*—Antonio R. Durando; Quarles & Brady Streich Lang

(57) ABSTRACT

A stirrup includes an elongated footrest as well as a hanger for suspending the stirrup from a saddle. The footrest and the hanger can pivot elastically relative to one another on an axis parallel to the longitudinal axis of the footrest.

22 Claims, 7 Drawing Sheets

STIRRUP WITH RELATIVELY MOVABLE FOOTREST AND HANGER

REFERENCE TO RELATED APPLICATION

This is a continuation-in-part application of Ser. No. 10/056,561, filed 25 Jan. 2002, now abandoned.

BACKGROUND OF THE INVENTION

1. Field of the Invention

The invention relates to a stirrup.

2. Description of the Prior Art

Stirrups come in different forms. The above-referenced application discloses a type of stirrup having a metallic footrest and a metallic hanger for suspending the stirrup from a saddle. The footrest is provided with an opening which is used to mount one or more shock absorbers on the footrest. An uppermost surface of the shock absorber or shock absorbers is nonslip to prevent the foot of a rider from sliding out of the stirrup.

The footrest and the hanger are rigidly connected to one another and are generally integral.

SUMMARY OF THE INVENTION

One aspect of the invention resides in a stirrup. The stirrup comprises a support for a foot, a suspending element for suspending the support from a saddle, and means connecting the support to the suspending element such that the support and the suspending element are movable relative to one another. It is preferred that the connecting means be designed to permit relative rotation of the support and the suspending element.

Another aspect of the invention resides in a method of assembling a stirrup. The method comprises the steps of providing a support for a foot, providing a suspending element for suspending the support from a saddle, and connecting the support and the suspending element so that the support and the suspending element are movable relative to one another. The connecting step is preferably carried out in such a manner that the support and the suspending element are rotatable with respect to each other.

The support and the suspending element can be substantially rigid and the connecting step may include establishing an elastic connection between the support and the suspending element.

The connecting step may further include anchoring a wire to the support. Here, the connecting step may additionally include arranging the wire so that the wire runs through the suspending element.

The wire can have at least one portion which projects from the suspending element and the connecting step may then include inserting such portion of the wire in a sleeve made of a material different from that of the support and from that of the suspending element.

The support can be provided with an anchoring element for the wire. In such an event, the method may further comprise the steps of providing a shock-absorbing element having a recess, and positioning the shock-absorbing element on said support.

When a wire is anchored to the support, the latter can be provided with an anchoring element for the wire. In such an event, the shock-absorbing element may be provided with a recess and the step of positioning the shock-absorbing element on the support may include inserting the anchoring element in the recess.

The support may be provided with an opening and the shock-absorbing element may be formed with a rib. The step of positioning the shock-absorbing element on the support can then include inserting the rib in the opening.

The method can additionally comprise the step of clamping the shock-absorbing element between the support and a friction element having a nonslip surface portion.

The shock-absorbing element may be designed in such a manner that at least a major part thereof is inflated with gas, e.g., air.

One more aspect of the invention resides in a method of using a stirrup having a support for a foot and a suspending element for suspending the support. This method comprises the steps of attaching the suspending element to a saddle, placing a foot on the support, and moving the support and the suspending element relative to one another. The moving step may involve rotating the support and the suspending element with respect to each other.

Additional features and advantages of the invention will be forthcoming from the following detailed description of specific embodiments when read in conjunction with the accompanying drawings.

DESCRIPTION OF THE PREFERRED EMBODIMENTS

Figure 1:
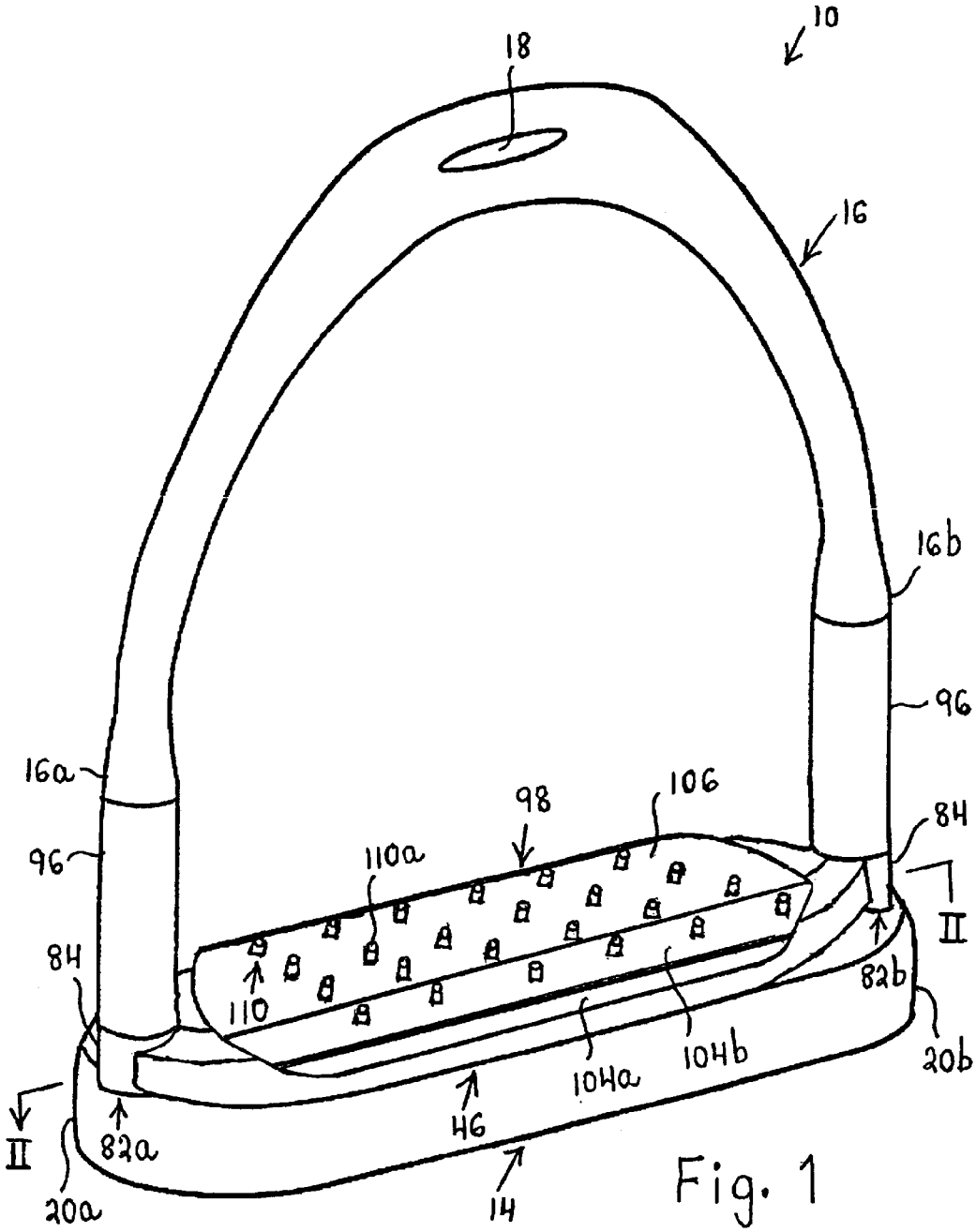
FIG. 1 is a perspective front view of a stirrup which is designed in accordance with the invention and includes a footrest with a shock-absorbing element and a friction element overlying the shock-absorbing element.
Figure 2:
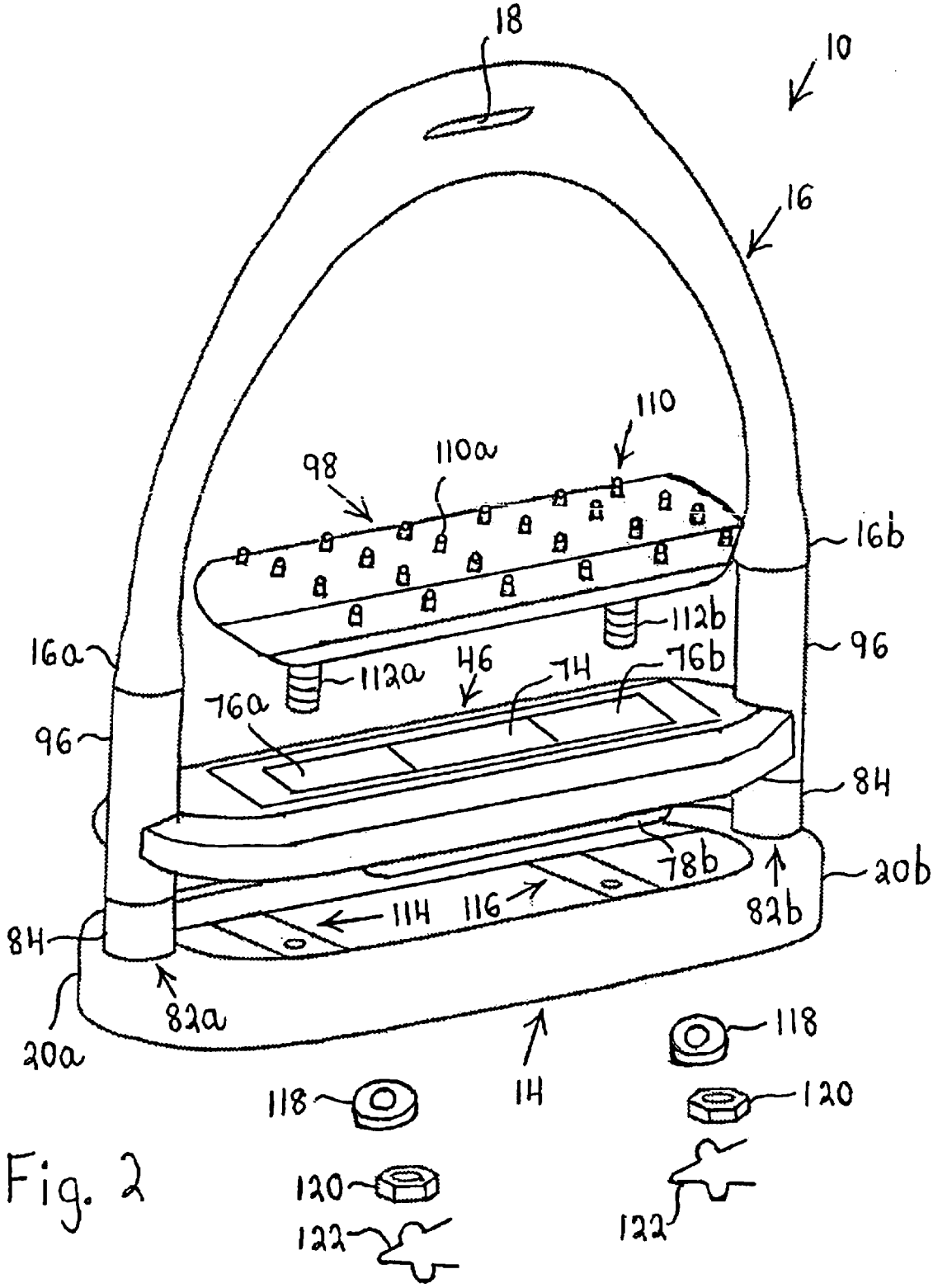
FIG. 2 is a partially exploded perspective front view of the stirrup of FIG. 1.

Referring to FIGS. 1 and 2, the numeral 10 identifies a stirrup according to the invention. The stirrup 10 includes a rigid metallic footrest 14 which constitutes a support for a foot and a U-shaped, rigid metallic hanger or suspending element 16 which serves to suspend the stirrup 10 from a saddle. The hanger 16, which is centered with respect to the footrest 14 laterally of the latter, is provided with a slot 18 for attaching the hanger 16 to the saddle.

Figure 3:
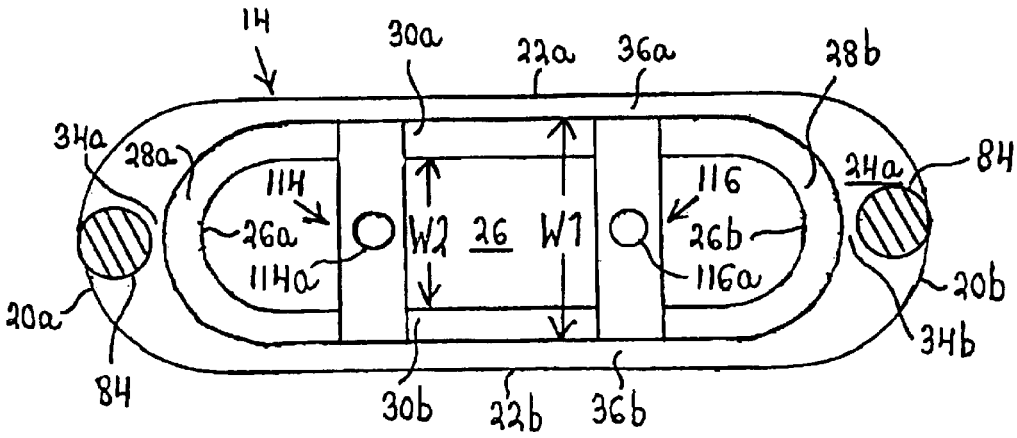
FIG. 3 is a section in the direction of the arrows II—II of FIG. 1 with the shock-absorbing element and the friction element removed to present a top view of the footrest of FIG. 1.
Figure 4:
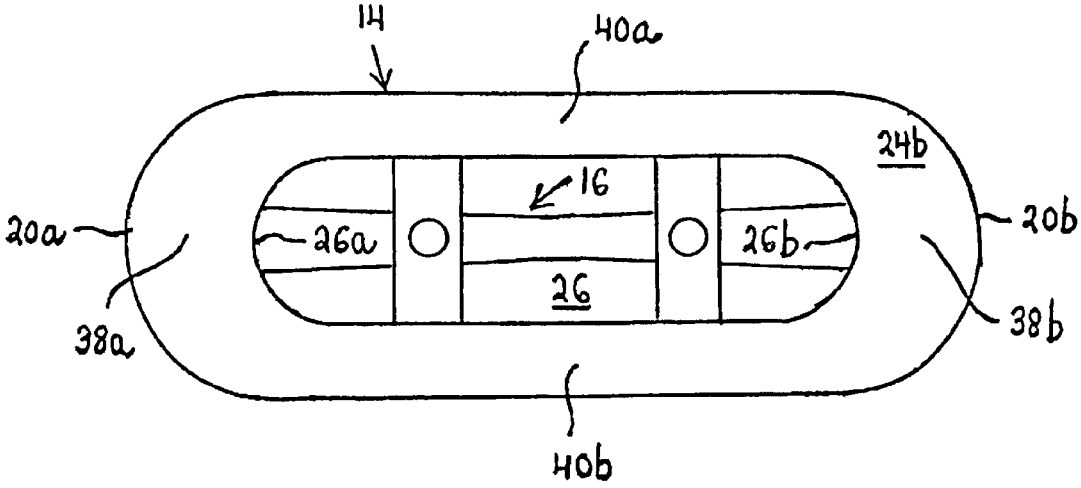
FIG. 4 is a bottom view of the footrest.
Figure 5:
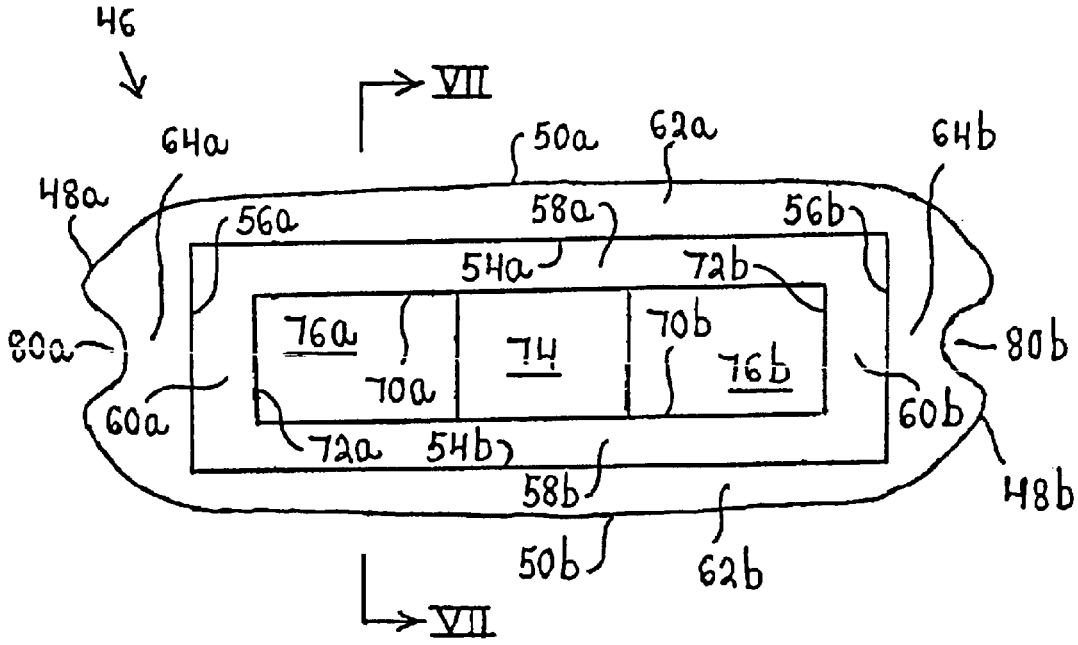
FIG. 5 is a top view of the shock-absorbing element of FIG. 1.
Figure 6:
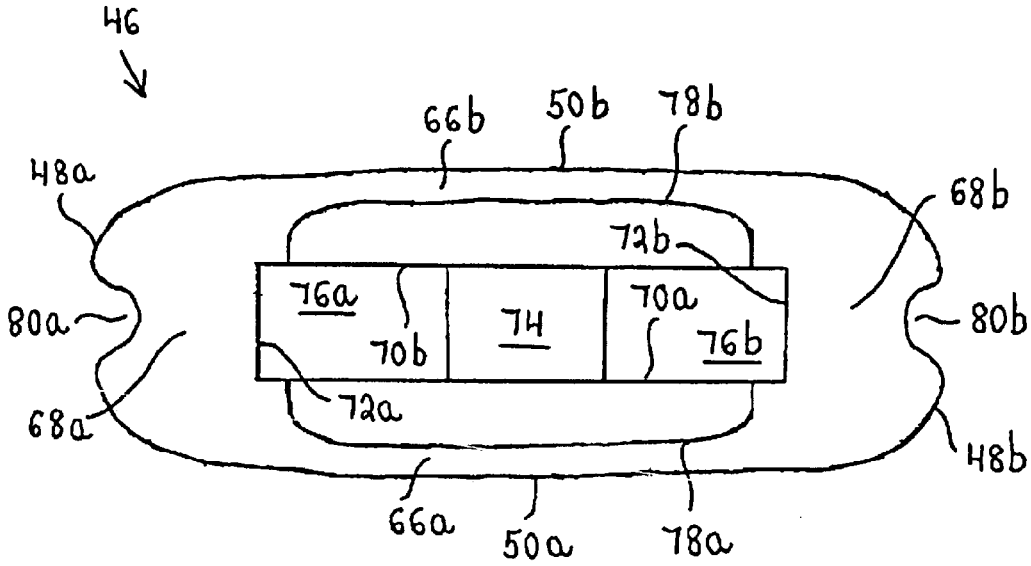
FIG. 6 is a bottom view of the shock-absorbing element of FIG. 5.
Figure 7:
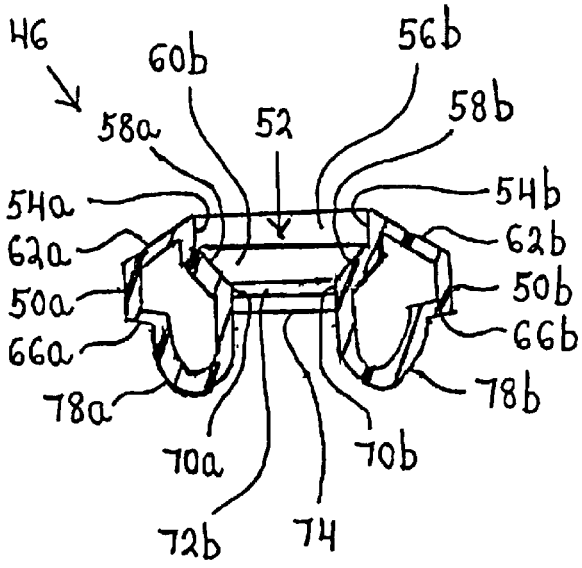
FIG. 7 is a sectional view of the shock-absorbing element of FIG. 5 as seen in the direction of the arrows VII—VII of FIG. 5.

Considering FIGS. 3 and 4 with FIGS. 1 and 2, the footrest 14 is elongated and has opposed longitudinal ends 20*a* and 20*b* which are convex as seen in a plan view. The footrest 14 further has two opposed longitudinally extending sides 22*a* and 22*b* which bridge the longitudinal ends

20*a*,20*b*, and the sides 22*a*,22*b* are straight and parallel to one another. In addition, the footrest 14 has two flat parallel surfaces 24*a* and 24*b* lying in respective planes which are generally perpendicular to the straight sides 22*a* and 22*b*. The flat surfaces 24*a*,24*b* face in opposite directions, and the straight sides 22*a*,22*b* run from one of the flat surfaces 24*a*,24*b* to the other. In use, the flat surface 24*a* faces up and can be considered to be an upper surface of the footrest 14 while the flat surface 24*b* faces down and can be considered to be a lower surface of the footrest 14.

The footrest 14 is formed with an elongated opening 26 having a shape similar to that of the footrest 14. The opening 26 has opposed longitudinal ends 26*a* and 26*b*, and the longitudinal end 26*a* of the opening 26 is located in the vicinity of the longitudinal end 20*a* of the footrest 14 while the longitudinal end 26*b* of the opening 26 is located in the vicinity of the longitudinal end 20*b* of the footrest 14. The elongated opening 26 extends from the upper surface 24*a* of the footrest 14 to the lower surface 24*b* and is bounded by a wall which slopes from the upper surface 24*a* to a location near the lower surface 24*b*. This wall has a concave segment 28*a* at the longitudinal end 26*a* of the opening 26 and a concave segment 28*b* at the longitudinal end 26*b* of the opening 26. The wall bounding the opening 26 further has two opposed segments 30*a* and 30*b* which face each other and run in the same direction as the straight sides 22*a*,22*b* of the footrest 14. Each of the segments 30*a*,30*b* extends from one of the concave segments 28*a*,28*b* to the other.

The wall 28*a*,28*b*,30*a*,30*b* bounding the elongated opening 26 in the footrest 14 slopes in such a manner that the cross-sectional area of the opening 26 at the upper surface 24*a* of the footrest 14 exceeds the cross-sectional area at the lower surface 24*b*. The elongated opening 26 has a maximum width W1 at the upper surface 24*a* and a smaller maximum width W2 at the lower surface 24*b*. Both the cross-sectional area and the maximum width of the elongated opening 26 decrease progressively from the upper surface 24*a* to the location where the wall 28*a*,28*b*,30*a*,30*b* stops sloping.

The upper surface 24*a* of the footrest 14 is made up of two curved sections 34*a* and 34*b* and two straight, strip-like sections 36*a* and 36*b*. The curved sections 34*a*,34*b* are respectively located at the longitudinal ends 26*a*,26*b* of the opening 26 in the footrest 14 while the strip-like sections 36*a*,36*b* run along opposite sides of the opening 26. Each of the strip-like sections 36*a*,36*b* bridges the curved sections 34*a*,34*b*.

In a similar fashion, the lower surface 24*b* of the footrest 14 is made up of two curved sections 38*a* and 38*b* and two straight, strip-like sections 40*a* and 40*b*. The curved sections 38*a*,38*b* are respectively located at the longitudinal ends 26*a*,26*b* of the opening 26 in the footrest 14 while the strip-like sections 40*a*,40*b* run along opposite sides of the opening 26. Each of the strip-like sections 40*a*,40*b* bridges the curved sections 38*a*,38*b*.

Referring to FIGS. 1, 2, 5, 6 and 7, the stirrup 10 comprises an elongated shock-absorbing or cushioning element 46 having opposed longitudinal ends 48*a* and 48*b*. The shock-absorbing element 46 further has two opposed longitudinally extending sides 50*a* and 50*b* which bridge the longitudinal ends 48*a*,48*b*, and the sides 50*a*,50*b* are generally straight and parallel to one another.

The shock-absorbing element 46 is provided with a depression 52 which is bounded by a rectangle including two longer straight surface sections 54*a* and 54*b* and two shorter straight surface sections 56*a* and 56*b*. The longer surface sections 54*a*,54*b* are generally parallel to one another and to the straight sides 50*a*,50*b* of the shock-absorbing element 46. The depression 52 further has a bottom defined by two longer sloping surface sections 58*a* and 58*b* and two shorter sloping surface sections 60*a* and 60*b*. The longer sloping surface sections 58*a*,58*b* run along the respective longer straight surface sections 54*a*,54*b* while the shorter sloping surface sections 60*a*,60*b* run along the respective shorter straight surface sections 56*a*,56*b*.

A sloping surface section 62*a* lies between the straight side 50*a* of the shock-absorbing element 46 and the longer straight surface section 54*a* of the depression 52. Similarly, a sloping surface section 62*b* lies between the straight side 50*b* of the shock-absorbing element 46 and the longer straight surface section 54*b* of the depression 52. The sloping surface sections 62*a*,62*b* bridge the longitudinal ends 48*a*,48*b* of the shock-absorbing element 46, and each of the sloping surface sections 62*a*,62*b* merges into a transverse surface section 64*a* on the longitudinal end 48*a* and a transverse surface section 64*b* on the longitudinal end 48*b*. The transverse surface sections 64*a*,64*b*, which may or may not be sloped, extend transversely of the shock-absorbing element 46 between the sloping surface sections 62*a*,62*b*. The sloping surface sections 62*a*,62*b*, as well as the transverse surface sections 64*a*,64*b*, face upward during use and can thus be considered to constitute upper surface sections of the shock-absorbing element 46.

The shock-absorbing element 46 has two additional surface sections 66*a* and 66*b* which face away from the sloping upper surface sections 62*a*,62*b*. The additional surface sections 66*a*,66*b* bridge the longitudinal ends 48*a*,48*b* of the shock-absorbing element 46, and each of the additional surface sections 66*a*,66*b* merges into a transverse surface section 68*a* on the longitudinal end 48*a* and a transverse surface section 68*b* on the longitudinal end 48*b*. The transverse surface sections 68*a*,68*b* extend transversely of the shock-absorbing element 46 between the additional surface sections 66*a*,66*b*. The additional surface sections 66*a*,66*b*, as well as the transverse surface sections 68*a*,68*b*, face downward during use and can thus be considered to constitute lower surface sections of the shock-absorbing element 46.

An elongated opening is formed centrally of the shock-absorbing element 46 between the sloping surface sections 58*a*,58*b*,60*a*,60*b* of the depression 52 and the lower surface sections 66*a*,66*b*,68*a*,68*b* of the shock-absorbing element 46. The opening, which registers with the depression 52, is bounded by a rectangle including two longer straight surface sections 70*a* and 70*b* and two shorter straight surface sections 72*a* and 72*b*. The longer surface sections 70*a*,70*b* are generally parallel to one another and to the straight sides 50*a*,50*b* of the shock-absorbing element 46.

A crosspiece 74 centered longitudinally of the opening in the shock-absorbing element 46 bridges the longer surface sections 70*a*,70*b* of the opening. The crosspiece 74 divides the opening into two apertures 76*a* and 76*b*.

The lower surface section 66*a* of the shock-absorbing element 46 is formed with an elongated rib or protuberance 78*a* which extends longitudinally of the shock-absorbing element 46. Likewise, the lower surface section 66*b* of the shock-absorbing element 46 is provided with an elongated rib or protuberance 78*b* which runs longitudinally of the shock-absorbing element 46. The ribs 78*a*,78*b* are arranged so that, when the shock-absorbing element 46 is properly placed on the footrest 14, the rib 78*a* lies proximate to or against the wall segment 30*a* of the opening 26 in the footrest 14 while the rib 78*b* lies proximate to or against the opposing wall segment 30*b*. The length of the rib 78*a* is equal to or less than the length of the wall segment 30*a* of the opening 26 and the length of the rib 78*b* is equal to or less than the length of the wall segment 30*b*. The ribs 78*a*,78*b* serve to position or align the shock-absorbing element 46 on the footrest 14 transversely of the latter.

Figure 8:
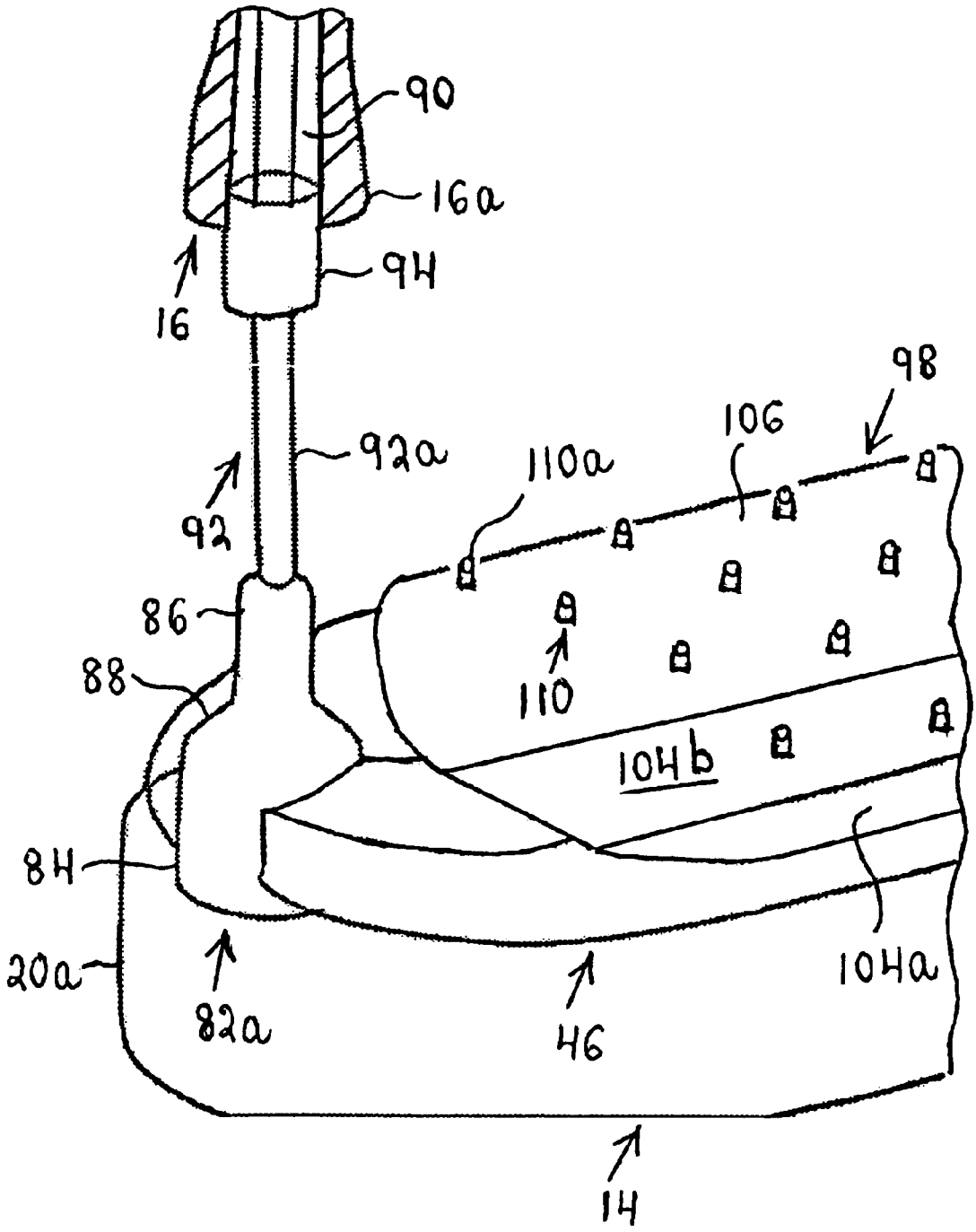
FIG. 8 is an enlarged, fragmentary, partly sectional perspective front view of the stirrup of FIG. 1 with a sleeve forming part of the stirrup removed.
Figure 9:
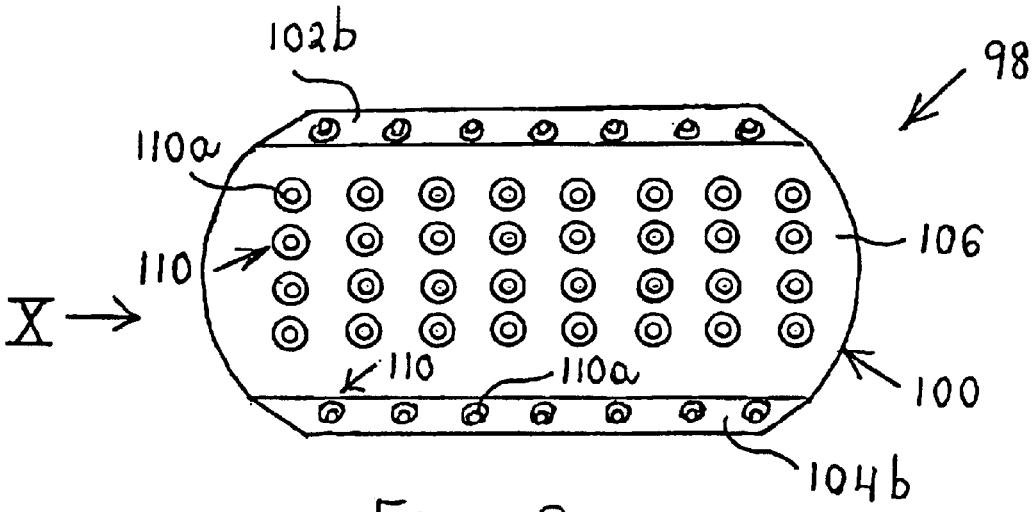
FIG. 9 is a plan view of the friction element of FIG. 1.
Figure 10:
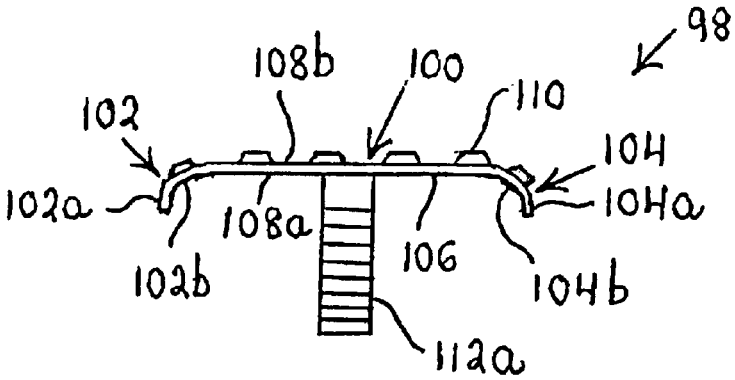
FIG. 10 is an end view of the friction element of FIG. 1 as seen in the direction of the arrow X of FIG. 9.

Turning to FIG. 8 in conjunction with FIGS. 1 and 2, the footrest 14 and the hanger 16 constitute two separate components which are connected to one another flexibly or elastically. The flexible or elastic connection between the footrest 14 and the hanger 16 allows the footrest 14 and the hanger 16 to move relative to each other. In the illustrated embodiment, the flexible or elastic connection is such that the footrest 14 and the hanger 16 can rotate or pivot with respect to one another on an axis parallel to the longitudinal axis of the footrest 14.

The hanger 16 has an end portion 16*a* at the longitudinal end 20*a* of the footrest 14 and another end portion 16*b* at the opposite longitudinal end 20*b* of the footrest 14, and the end portions 16*a*,16*b* face the footrest 14. The end portion 16*a* of the hanger 16 and the longitudinal end 20*a* of the footrest 14 are joined to each other flexibly or elastically as are the end portion 16*b* of the hanger 16 and the longitudinal end 20*b* of the footrest 14.

An anchoring element 82*a* is mounted on the upper surface 24*a* of the footrest 14 at the longitudinal end 20*a* of the footrest 14 while an anchoring element 82*b* is mounted on the upper surface 24*a* at the longitudinal end 20*b*. As illustrated in FIG. 8 for the anchoring element 82*a*, each of the anchoring elements 82*a*,82*b* includes a cylindrical portion 84 of circular cross section having a larger diameter, a cylindrical portion 86 of circular cross section having a smaller diameter and a frustoconical portion 88 connecting the cylindrical portions 84*a*,84*b* to one another. The larger cylindrical portion 84 of each anchoring element 82*a*,82*b* sits on the upper surface 24*a* of the footrest 14 and serves as a base for the smaller cylindrical portion 86.

The hanger 16 of the stirrup 10 is provided with a passage 90 which runs from the end portion 16*a* of the hanger 16 to the end portion 16*b* thereof. A wire or cable 92 extends through the passage 90 and has opposite end portions 92*a* (only one visible in the drawings) which respectively project from the end portions 16*a*,16*b* of the hanger 16. Part of each wire end portion 92*a* is embedded in and gripped by the respective anchoring element 82*a*,82*b* so that the wire 92 is anchored to the footrest 14 and establishes a connection between the footrest 14 and the hanger 16.

The end portions 16*a*,16*b* of the hanger 16 are spaced from the respective anchoring elements 82*a*,82*b* by gaps, and the part of each wire end portion 92*a* which is not embedded in the respective anchoring element 82*a*,82*b* bridges the corresponding gap. The wire 92 is flexible or elastic thereby allowing the parts of the wire 92 between the hanger 16 and the anchoring elements 82*a*,82*b* to bend. When the parts of the wire 92 between the hanger 16 and the anchoring elements 82*a*,82*b* are bent about an axis running parallel to the longitudinal axis of the footrest 14, the footrest 14 and the hanger 16 rotate relative to one another on this axis. The wire 92 can, for example, be made of steel.

The passage 90 of the hanger 16 has a circular cross section and a plug or insert 94 of circular cross section extends into the passage 90 through each of the end portions 16*a*,16*b* of the hanger 16 (only the plug 94 for the end portion 16*a* is shown in the drawings). Each of the plugs 94 is provided with a channel of circular cross section for the wire 92, and each of the plugs 94 is arranged so that part of the respective plug 94 is located internally of the hanger 16 and part is located externally of the hanger 16. The plugs 94 are fast with the hanger 16 and can be a friction fit in the passage 90 and/or can be attached to the hanger 16 in a suitable manner.

Each of the two parts of the wire 92 spanning the hanger 16 and the anchoring elements 82*a*,82*b* is surrounded by a sleeve or housing 96 of circular cross section, and each of the sleeves 96 is formed with a passage of circular cross section. One end of each sleeve 96 receives the smaller cylindrical portion 86 of the respective anchoring element 82*a*,82*b* while the other end of each sleeve 96 receives the part of the respective plug 94 located externally of the hanger 16. The plugs 94 and the smaller cylindrical portions 86 of the anchoring elements 82*a*,82*b* are fast with the sleeves 96, and the plugs 94 and smaller cylindrical portions 86 can be a friction fit in the sleeves 96 and/or can be attached to the sleeves 96 in a suitable manner.

The sleeves 96 are flexible or elastic thereby allowing the sleeves 96 to bend together with the parts of the wire 92 between the hanger 16 and the anchoring elements 82*a*,82*b*. By virtue of the construction in the illustrated embodiment of the stirrup 10, the sleeves 96 and the parts of the wire 92 spanning the hanger 16 and the anchoring elements 82*a*,82*b* are constrained to bend about an axis running parallel to the longitudinal axis of the footrest 14.

The sleeve 96 at the longitudinal end 20*a* of the footrest 14 may be arranged so that the end of the sleeve 96 which receives the plug 94 butts the end portion 16*a* of the hanger 16 and the end of the sleeve 96 which receives the smaller cylindrical portion 86 of the anchoring element 82*a* butts the larger cylindrical portion 84 of the anchoring element 82*a*. Similarly, the sleeve 96 at the longitudinal end 20*b* of the footrest 14 may be arranged so that the end of the sleeve 96 which receives the plug 94 butts the end portion 16*b* of the hanger 16 and the end of the sleeve 96 which receives the smaller cylindrical portion 86 of the anchoring element 82*b* butts the larger cylindrical portion 84 of the anchoring element 82*b*. The sleeves 96 then bridge the hanger 16 and the anchoring elements 82*a*,82*b* on the footrest 14. The sleeves 96, the larger cylindrical portions 84 of the anchoring elements 82*a*,82*b* and the end portions 16*a*,16*b* of the hanger 16 can all have the same outer diameter so that a smooth transition from the footrest 14 to the hanger 16 exists at each of the longitudinal ends 20*a*,20*b* of the footrest 14.

The sleeves 96, which constitute cylindrical elements of circular cross section, may be made of material different from that of the footrest 14 and from that of the hanger 16. By way of example, the footrest 14 and the hanger 16 can be made of steel while the sleeves 96 are made of rubber.

Returning to FIGS. 5 and 6 in conjunction with FIG. 1, the shock-absorbing element 46 is provided with a recess or indentation 80*a* at the longitudinal end 48*a* of the shock-absorbing element 46 and with a recess or indentation 80*b* at the longitudinal end 48*b*. The recesses 80*a*,80*b* are centered transversely of the shock-absorbing element 46 and, when the shock-absorbing element 46 is properly placed on the footrest 14, the recess 80*a* receives the larger cylindrical portion 84 of the anchoring element 82*a* whereas the recess 80*b* receives the larger cylindrical portion 84 of the anchoring element 82*b*. The recesses 80*a*,80*b* help to position or align the shock-absorbing element 46 on the footrest 14 transversely of the latter and also serve to confine the shock-absorbing element 46 longitudinally of the footrest 14.

The longitudinal end 48*a* of the shock-absorbing element 46 is convex, as seen in a plan view, between the recess 80*a* and the respective sloping surface sections 62*a,*62*b* of the shock-absorbing element 46. Similarly, the longitudinal end 48*b* of the shock-absorbing element 46 is convex, as seen in a plan view, between the recess 80*b* and each of the sloping surface sections 62*a,*62*b*. Hence, the contours of the longitudinal ends 48*a,*48*b* of the shock-absorbing element 46 conform to the contours of the respective longitudinal ends 20*a,*20*b* of the footrest 14.

The shock-absorbing element 46, or at least the major part thereof, preferably comprises a body inflated with gas. This allows the shock-absorbing element 46 to function as a gas pad or cushion. The shock-absorbing element 46 can be made of plastic and the gas used to inflate the shock-absorbing element 46 may be air. In the illustrated embodiment, all of the shock-absorbing element 46 except for the crosspiece 74 is inflated with gas.

Referring to FIGS. 1, 2, 8 and 9, the stirrup 10 further comprises a tread or friction element 98 discrete from the footrest 14 and from the shock-absorbing element 46. The tread 98 includes an elongated sheet-like element 100 with opposite longitudinal ends 100*a* and 100*b* having rounded convex edges. The sheet-like element 100 is U-shaped as viewed on end and includes two spaced legs 102 and 104 which run longitudinally of the sheet-like element 100 and are connected to one another by a generally flat crosspiece 106. The sheet-like element 100 has a surface 108*a* which faces inward of the sheet-like element 100 and an opposed surface 108*b* which faces outward of the sheet-like 100. The inward facing surface 108*a* will here be referred to as the inner surface of the sheet-like element 100 while the outward facing surface 108*b* will be referred to as the outer surface of the sheet-like element 100.

The tread 98 is designed to rest on the shock-absorbing element 46 with the longitudinal end 100*a* of the sheet-like element 100 proximate to the longitudinal end 48*a* of the shock-absorbing element 46 and the longitudinal end 100*b* of the sheet-like element 100 proximate to the longitudinal end 48*b* of the shock-absorbing element 46. When the tread 98 is properly positioned on the shock-absorbing element 46, the inner surface 108*b* of the sheet-like element 100 is directed towards the shock-absorbing element 46. The length of the sheet-like element 100 is such that the inner surface 108*b* of the sheet-like element 100 can bear against the transverse surface section 64*a* at the longitudinal end 48*a* of the shock-absorbing element 46 and against the transverse surface section 64*b* at the longitudinal end 48*b* of the shock-absorbing element 46.

The leg 102 of the sheet-like element 100 has a straight flat section 102*a* which is spaced from the crosspiece 106 and lies in a plane normal to the plane of the crosspiece 106. The leg 102 further has a straight flat section 102*b* which bridges the crosspiece 106 and the flat section 102*a* and is sloped relative to the crosspiece 106 and the flat section 102*a*. The leg section 102*a* is designed to lie against the straight side 50*a* of the shock-absorbing element 46 whereas the leg section 102*b* is designed to lie against the sloping surface section 62*a* of the shock-absorbing element 46.

Similarly, the leg 104 of the sheet-like element 100 has a straight flat section 104*a* which is spaced from the crosspiece 106 and is located in a plane normal to the plane of the crosspiece 106. The leg 104 further has a straight flat section 104*b* which spans the crosspiece 106 and the flat section 104*a* and is sloped relative to the crosspiece 106 and the flat section 104*a*. The leg section 104*a* is designed to bear against the straight side 50*b* of the shock-absorbing element 46 whereas the leg section 104*b* is designed to bear against the sloping surface section 62*b* of the shock-absorbing element 46.

The sheet-like element 100 is formed with perforate dimples or protrusions 110 which project to the outside of the sheet-like element 100 and cause the outer surface 108*a* thereof to be nonslip. The dimples 110 are perforate, and each of the dimples 110 has a central opening 110*a*. The outer surface 108*a* of the sheet-like element 100 is arranged to support the foot of a rider employing the stirrup 10, and this surface constitutes a friction surface which prevents the foot of the rider from slipping out of the stirrup 10.

The inner surface 108*b* of the sheet-like element 100 is provided with two threaded studs or projections 112*a* and 112*b*. The studs 112*a,*112*b* are spaced from each other longitudinally of the tread 98 and are centered laterally of the tread 98.

Considering FIGS. 2 and 3, the footrest 14 is formed with two webs or strip-like elements 114 and 116 which are spaced from one another longitudinally of the footrest 14 and bridge the strip-like sections 36*a,*36*b* thereof. The web 114 is provided with an opening or perforation 114*a* which is centered laterally and longitudinally of the web 114 while the web 116 is provided with an opening or perforation 116*a* which is centered laterally and longitudinally of the web 116. The openings 114*a,*116*a* are spaced from each other by the same distance as the studs 112*a,*112*b* on the tread 98. The opening 114*a* is arranged to be aligned with the aperture 76*a* of the shock-absorbing element 46 whereas the opening 116*a* is arranged to be aligned with the aperture 76*b*.

When the tread 98 is properly positioned on the footrest 14, the stud 112*a* extends through the aperture 76*a* of the shock-absorbing element 46 and through the opening 114*a* of the web 114. In a similar vein, the stud 112*b* passes through the aperture 76*b* of the shock-absorbing element 46 and through the opening 116*a* of the web 116. The studs 112*a,*112*b* project to the side of the webs 114,116 remote from the shock-absorbing element 46, and the projecting portions of the studs 112*a,*112*b* are of such length that a washer 118 and a nut 120 may be placed on each of these projecting portions. A clamp 122 can be applied to each of the studs 112*a,*112*b* on the side of the respective nut 120 remote from the associated washer 118 to prevent loosening of the nut 120.

Upon tightening the nuts 120, the shock-absorbing element 46 is clamped between the tread 98 and the footrest 14.

One manner of assembling the stirrup 10 is as follows:

The hanger 16 with the wire 92 running therethrough is fabricated in a manner known per se as is the footrest 14 with the anchoring elements 82*a,*82*b*. Each of the anchoring elements 82*a,*82*b* is formed with a passage for a respective end portion 92*a* of the wire 92.

Before the end portions 92*a* of the wire 92 are inserted in the anchoring elements 82*a,*82*b*, one of the plugs 94 is placed on each end portion 92*a*. The plugs 94 are advanced to the respective end portions 16*a,*16*b* of the hanger 16 and pushed into the passage 90 of the hanger 16 so that part of each plug 94 is inside the passage 90 and part of each plug 94 is outside of the passage 90. The plugs 94 are made fast with the hanger 16 by a friction fit in the passage 90 and/or by bonding the plugs 90 to the hanger 16.

Once the plugs 94 are fast with the hanger 16, one of the sleeves 96 is placed on each of the end portions 92*a* of the wire 92. The sleeves 96 are pushed over the respective plugs 94 and into abutment with the respective end portions

16*a*,16*b* of the hanger 16. The sleeves 96 are made fast with the plugs 94 by a friction fit on the plugs 94 and/or by bonding the sleeves 96 to the plugs 94.

After the sleeves 96 have been made fast with the plugs 94, the smaller cylindrical portions 86 of the anchoring elements 82*a*,82*b* are pushed into the respective sleeves 96. As the anchoring elements 82*a*,82*b* advance into the sleeves 96, the end portions 92*a* of the wire 92 enter the passages in the respective anchoring elements 82*a*,82*b*. The anchoring elements 82*a*,82*b* continue to be pushed into the sleeves 96 until the larger cylindrical portions 84 of the anchoring elements 82*a*,82*b* abut the sleeves 96. The sleeves 96 are made fast with the anchoring elements 82*a*,82*b* by a friction fit on the smaller cylindrical portions 86 and/or by bonding the sleeves 96 to the anchoring elements 82*a*,82*b*. The end portions 92*a* of the wire 92 are likewise made fast with the anchoring elements 82*a*,82*b*. This can be accomplished by placing a bonding agent in the passages of the anchoring elements 82*a*,82*b* prior to insertion of the end portions 92*a* of the wire 92 in the passages. Alternatively, the end portions 92*a* of the wire 92 can be bonded to the anchoring elements 82*a*,82*b* by welding or brazing, for example. In such an event, the sleeves 96 are put in place after the end portions 92*a* have been connected to the anchoring elements 82*a*,82*b*. Thus, each of the sleeves 96 is then supplied as two semicylindrical sections which are butted and bonded to one another once the end portions 92*a* of the wire 92 have been secured to the anchoring elements 82*a*,82*b*.

The shock-absorbing element 46 is now placed on the footrest 14. The shock-absorbing element 46 is positioned on the upper surface 24*a* of the footrest 14 with the depression 52 in the shock-absorbing element 46 facing the hanger 16 of the footrest 14. The lower surface section 66*a* of the shock-absorbing element 46 rests on the strip-like section 36*a* of the upper footrest surface 24*a* and the lower surface section 66*b* of the shock-absorbing element 46 rests on the strip-like section 36*b*. In addition, the lower surface section 68*a* of the shock-absorbing element 46 rests on the curved section 34*a* of the upper footrest surface 24*a* whereas the lower surface section 68*b* of the shock-absorbing element 46 rests on the curved section 34*b*.

The ribs 78*a*,78*b* of the shock-absorbing element 46 are inserted in the opening 26 of the footrest 14 with the rib 78*a* running alongside the wall segment 30*a* of the opening 26 and the rib 78*b* running alongside the wall segment 30*b*. Moreover, the anchoring element 82*a* is introduced into the recess 80*a* of the shock-absorbing element 46 while the anchoring element 82*b* is introduced into the recess 80*b*. The ribs 78*a*,78*b* and the recesses 80*a*,80*b* serve to locate the shock-absorbing element 46 on the footrest 14. When the shock-absorbing element 46 is properly situated on the footrest 14, the aperture 76*a* of the shock-absorbing element 46 is aligned with the opening 114*a* in the web 114 of the footrest 14. Likewise, the aperture 76*b* of the shock-absorbing element 46 is aligned with the opening 116*a* in the web 116 of the footrest 14.

After the shock-absorbing element 46 has been placed on the footrest 14, the tread 98 is positioned with the stud 112*a* facing and in register with the aperture 76*a* of the shock-absorbing element 46 and with the stud 112*b* facing and in register with the aperture 76*b* of the shock-absorbing element 46. The studs 112*a*,112*b* are then passed through the respective apertures 76*a*,76*b* and into the openings 114*a*, 116*a* of the respective webs 114,116 formed on the footrest 14. The studs 112*a*,112*b* are advanced until the sheet-like element 100 of the tread 98 rests against the shock-absorbing element 46. When the sheet-like element 100 bears against the shock-absorbing element 46, a portion of each stud 112*a*,112*b* projects to the side of the webs 114,116 remote from the shock-absorbing element 46.

The washers 118 are placed on the projecting portions of the studs 112*a*,112*b* and brought into abutment with the webs 114,116 of the footrest 14. Subsequently, the nuts 120 are screwed onto the studs 112*a*,112*b* and urged against the washers 118 thereby causing the shock-absorbing element 46 to be clamped between the footrest 14 and the tread 98. After the nuts 120 have been tightened, the clamps 122 are placed on the studs 112*a*,112*b* adjacent to the nuts 120 so as to inhibit loosening of the nuts 120.

To use the stirrup 10, a saddle is secured to an animal, such as a horse, which is suited for riding. A strap is passed through the slot 18 of the hanger 16 and attached to the saddle after which a rider places his or her foot on the tread 98 and swings into the saddle. Once the rider is in the saddle and urges the animal to move, the rider's foot tends to pivot back-and-forth. This tendency causes the footrest 14 to rotate or pivot elastically relative to the hanger 16 on an axis which is parallel to the longitudinal axis of the footrest 14.

Various modifications are possible within the meaning and range of equivalence of the appended claims.

I claim:

1. A stirrup comprising:

a support for a foot;

a suspending element for suspending said support from a saddle; and means for connecting said support to said suspending element such that said support and said suspending element are movable relative to one another;

wherein said connecting means comprises a wire, said support is elongated and has opposite longitudinal ends, the wire is anchored to the support in a region of each of said ends and the wire extends through said suspending element.

2. The stirrup of claim 1, wherein said support and said suspending element are rotatable relative to one another.

3. The stirrup of claim 1, wherein said support and said suspending element are substantially rigid and said connecting means is elastic.

4. The stirrup of claim 1, wherein said support and said suspending element consist essentially of metal and said connecting means comprises a nonmetallic element.

5. The stirrup of claim 4, wherein said nonmetallic element comprises rubber.

6. The stirrup of claim 1, wherein said wire has at least one portion which projects from said suspending element, said connecting means including a sleeve on said one portion of said wire, and said sleeve being made of material different from that of said support and different from that of said suspending element.

7. The stirrup of claim 1, wherein said suspending element has an end which faces and is spaced from said support, said connecting means including a substantially cylindrical element of substantially circular cross section which bridges said support and said end.

8. The stirrup of claim 1, wherein said connecting means comprises a wire and an anchoring element on said support for anchoring said wire to said support; and further comprising a shock-absorbing element designed to be secured to said support, said shock-absorbing element being provided with at least one recess designed to receive said anchoring element and position said shock-absorbing element on said support.

9. The stirrup of claim 1, further comprising a friction element designed to be secured to said support, said friction element having a nonslip surface portion.

10. The stirrup of claim 9, wherein said surface portion is dimpled.

11. The stirrup of claim 9, wherein said support has a first side, an opposite second side, an opening extending from said first side to said second side and a crosspiece spanning said opening, said crosspiece being provided with a perforation, and said friction element including a projection designed to be received by said perforation.

12. The stirrup of claim 11, further comprising a shock-absorbing element designed to be positioned between said friction element and said support, said shock-absorbing element being provided with an aperture which is designed to be aligned with said perforation and receive said projection.

13. The stirrup of claim 9, further comprising a shock-absorbing element designed to be positioned between said friction element and said support, and means for securing said friction element to said support such that said shock-absorbing element is clamped between said friction element and said support.

14. A stirrup comprising:

a support for a foot;

a suspending element for suspending said support from a saddle; and means for connecting said support to said suspending element such that said support and said suspending element are movable relative to one another;

wherein said support is provided with an opening; and further comprising a shock-absorbing element designed to be secured to said support, said shock-absorbing element being provided with at least one rib designed to project into said opening and position said shock-absorbing element on said support.

15. A stirrup comprising:

a support for a foot;

a suspending element for suspending said support from a saddle; and means for connecting said support to said suspending element such that said support and said suspending element are movable relative to one another; and a shock-absorbing element designed to be secured to said support, at least a major part of said shock-absorbing element being inflated with gas.

16. The stirrup of claim 15, wherein said gas comprises air.

17. A method of assembling a stirrup comprising the steps of:

providing a support for a foot;

providing a suspending element for suspending said support from a saddle; and connecting said support and said suspending element such that said support and said suspending element are movable relative to one another;

wherein the connecting step comprises anchoring a wire to said support; and wherein the connecting step comprises arranging said wire so that said wire runs through said suspending element.

18. The method of claim 17, wherein said wire has at least one portion which projects from said suspending element and the connecting step comprises inserting said one portion of said wire in a sleeve made of a material different from that of said support and from that of said suspending element.

19. The method of claim 17, wherein said support is provided with an anchoring element for said wire; and further comprising the steps of providing a shock-absorbing element having a recess, and positioning said shock-absorbing element on said support, the positioning step including inserting said shock-absorbing element in said recess.

20. A method of assembling a stirrup comprising the steps of:

providing a support for a foot;

providing a suspending element for suspending said support from a saddle; and connecting said support and said suspending element such that said support and said suspending element are movable relative to one another;

wherein said support is provided with an opening; and further comprising the steps of providing a shock-absorbing element having a rib, and positioning said shock-absorbing element on said support, the positioning step including inserting said rib in said opening.

21. A method of assembling a stirrup comprising the steps of:

providing a support for a foot;

providing a suspending element for suspending said support from a saddle;

connecting said support and said suspending element such that said support and said suspending element are movable relative to one another;

providing a shock-absorbing element; and positioning said shock-absorbing element on said support, at least a major part of said shock-absorbing element being inflated with gas.

22. A method of assembling a stirrup comprising the steps of:

providing a support for a foot;

providing a suspending element for suspending said support from a saddle;

connecting said support and said suspending element such that said support and said suspending element are movable relative to one another;

positioning a shock-absorbing element on said support; and clamping said shock-absorbing element between said support and a friction element having a nonslip surface portion.

* * * * *